US007900327B2

(12) United States Patent
Elhaj

(10) Patent No.: US 7,900,327 B2
(45) Date of Patent: Mar. 8, 2011

(54) BROKEN HEART SHAPED VAULT

(76) Inventor: Antoine Elhaj, Sandusky, OH (US)

( * ) Notice: Subject to any disclaimer, the term of this patent is extended or adjusted under 35 U.S.C. 154(b) by 156 days.

(21) Appl. No.: 12/468,861

(22) Filed: May 19, 2009

(65) Prior Publication Data

US 2010/0293768 A1 Nov. 25, 2010

(51) Int. Cl.
*A61G 17/00* (2006.01)

(52) U.S. Cl. ..... 27/35; 52/128; 52/133; 52/139

(58) Field of Classification Search ..... 27/35, 27; D99/2; 52/128, 133, 134, 136, 139–142
See application file for complete search history.

(56) References Cited

U.S. PATENT DOCUMENTS

| | | | | | |
|---|---|---|---|---|---|
| 2,162,435 | A | * | 6/1939 | Hopkins | 52/141 |
| 2,247,617 | A | * | 7/1941 | Metz | 27/35 |
| 2,658,253 | A | * | 11/1953 | Richardson | 27/35 |
| 5,590,446 | A | * | 1/1997 | Hicks | 27/1 |
| D509,637 | S | * | 9/2005 | Wozniak | D99/5 |
| D515,267 | S | * | 2/2006 | Wozniak | D99/5 |
| D543,005 | S | * | 5/2007 | Pertz | D99/5 |
| D611,675 | S | * | 3/2010 | Elhaj | D99/5 |
| D622,024 | S | * | 8/2010 | School | D99/5 |
| 2010/0212125 | A1 | * | 8/2010 | Elhaj | 27/27 |
| 2010/0212355 | A1 | * | 8/2010 | Elhaj | 63/1.14 |

* cited by examiner

*Primary Examiner* — William L. Miller
(74) *Attorney, Agent, or Firm* — Ronald J. Koch

(57) ABSTRACT

A vault having a rectangular cover, and a rectangular enclosure assembly having a rectangular bottom and a vertical side wall attached to the bottom essentially around the periphery thereof, a curved support base adapted to hold a heart shaped coffin, and four curved support members attached to the bottom and being adapted to support the curved support base vertically above the bottom.

3 Claims, 11 Drawing Sheets

BROKEN HEART SHAPED VAULT

The present application is related to the co-pending patent application Ser. No. 12/390,400 of Antoine Elhaj, filed Feb. 20, 2009, entitled "Broken Heart Shaped Coffin"; and Ser. No. 12/430,882 of Antoine Elhaj, filed Apr. 27, 2009, entitled "Broken Heart Shaped Coffin", and based on which priority is herewith claimed under 35 U.S.C. 120 and the disclosures of which are incorporated herein by reference in its entirety as if fully rewritten herein.

BACKGROUND AND SUMMARY

The present invention relates generally to vaults for coffins and specifically to vaults having unique shapes or capable of holding coffins of unique shapes. The terms casket and coffin as used herein are interchangeable.

One embodiment of an half heart shaped vault comprises a half heart shaped cover and a half heart shaped enclosure having a bottom and a vertical side wall that forms essentially a half heart shape whereby a heart shaped coffin (see U.S. application Ser. No. 12/390,400 of Antoine Elhaj, filed Feb. 20, 2009, entitled "Broken Heart Shaped Coffin"; and Ser. No. 12/430,882 of Antoine Elhaj, filed Apr. 27, 2009, entitled "Broken Heart Shaped Coffin") can be placed therein.

Another embodiment (FIGS. 1 & 2) comprises a complementary pair of first and second half heart shaped vaults being mirror images of each other so that they can be buried in the ground to form a unitary heart shape.

One embodiment of a vault comprises, a rectangular cover, and a rectangular enclosure assembly having, a rectangular bottom and a vertical side wall attached to the bottom essentially around the periphery thereof, a curved support base adapted to hold a heart shaped coffin, and four curved support members attached to the bottom and being adapted to support the curved support base vertically above the bottom.

One of skill in the art would appreciate that other means are possible of vertically supporting the curved base member sufficient to hold a coffin (e.g. it could be attached directly to the side walls or rest upon posts).

REFERENCE NUMERALS IN DRAWINGS

Figure 1:
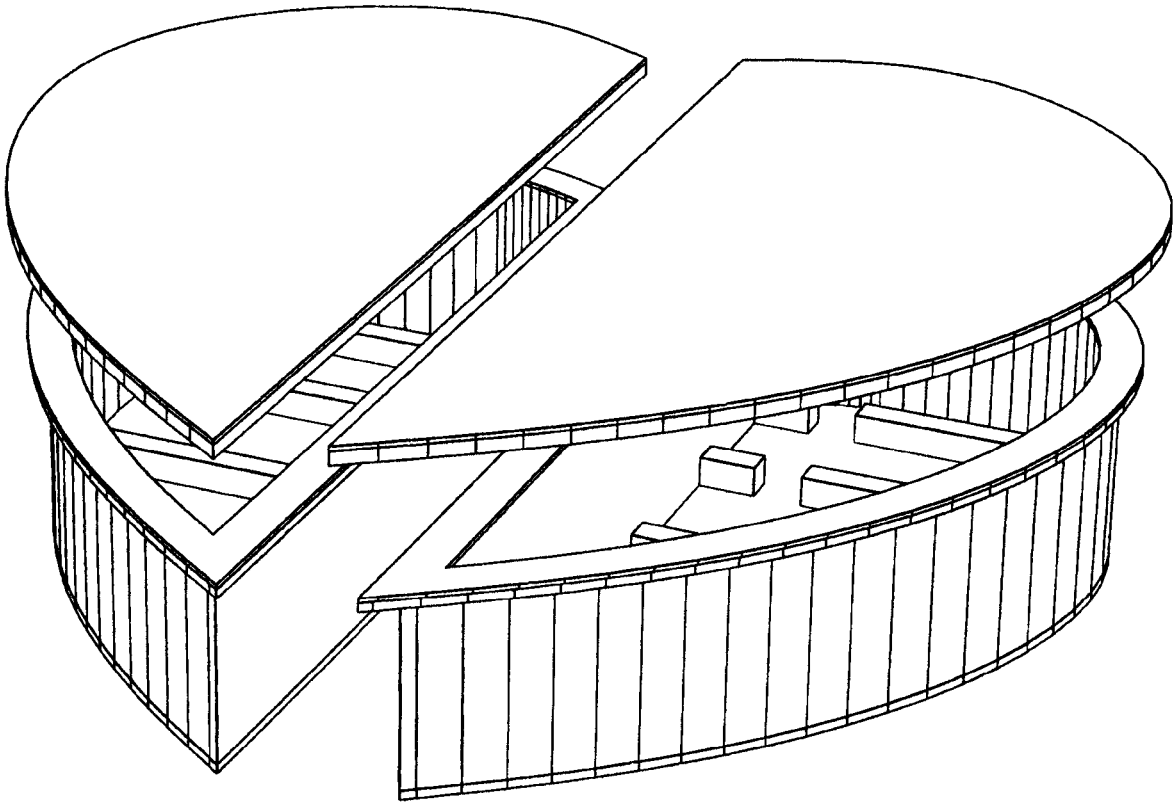
FIG. 1 depicts a perspective view of one embodiment of complementary half heart shaped vaults
Figure 2:
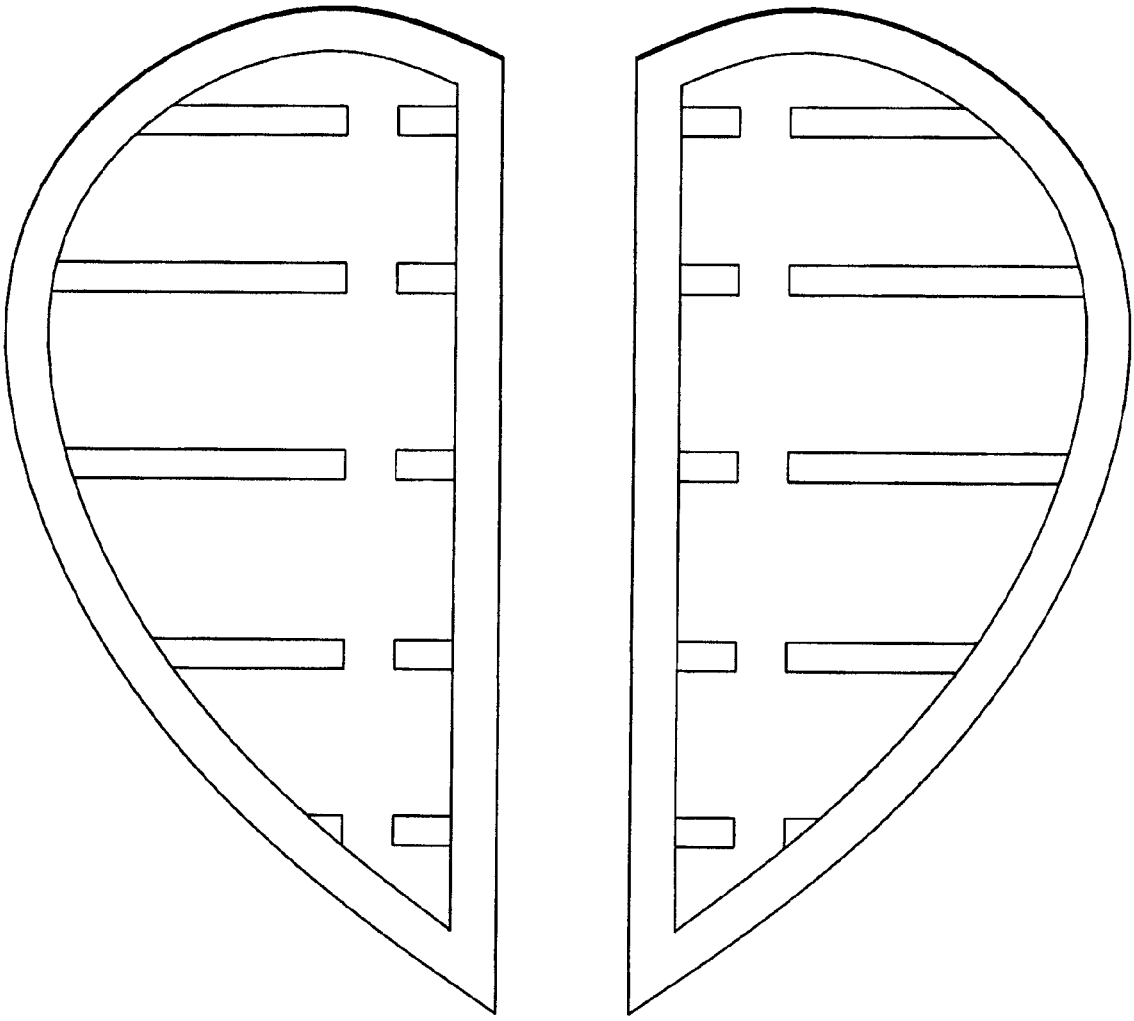
FIG. 2 depicts a top view of one embodiment of complementary half heart shaped vaults
Figure 3:
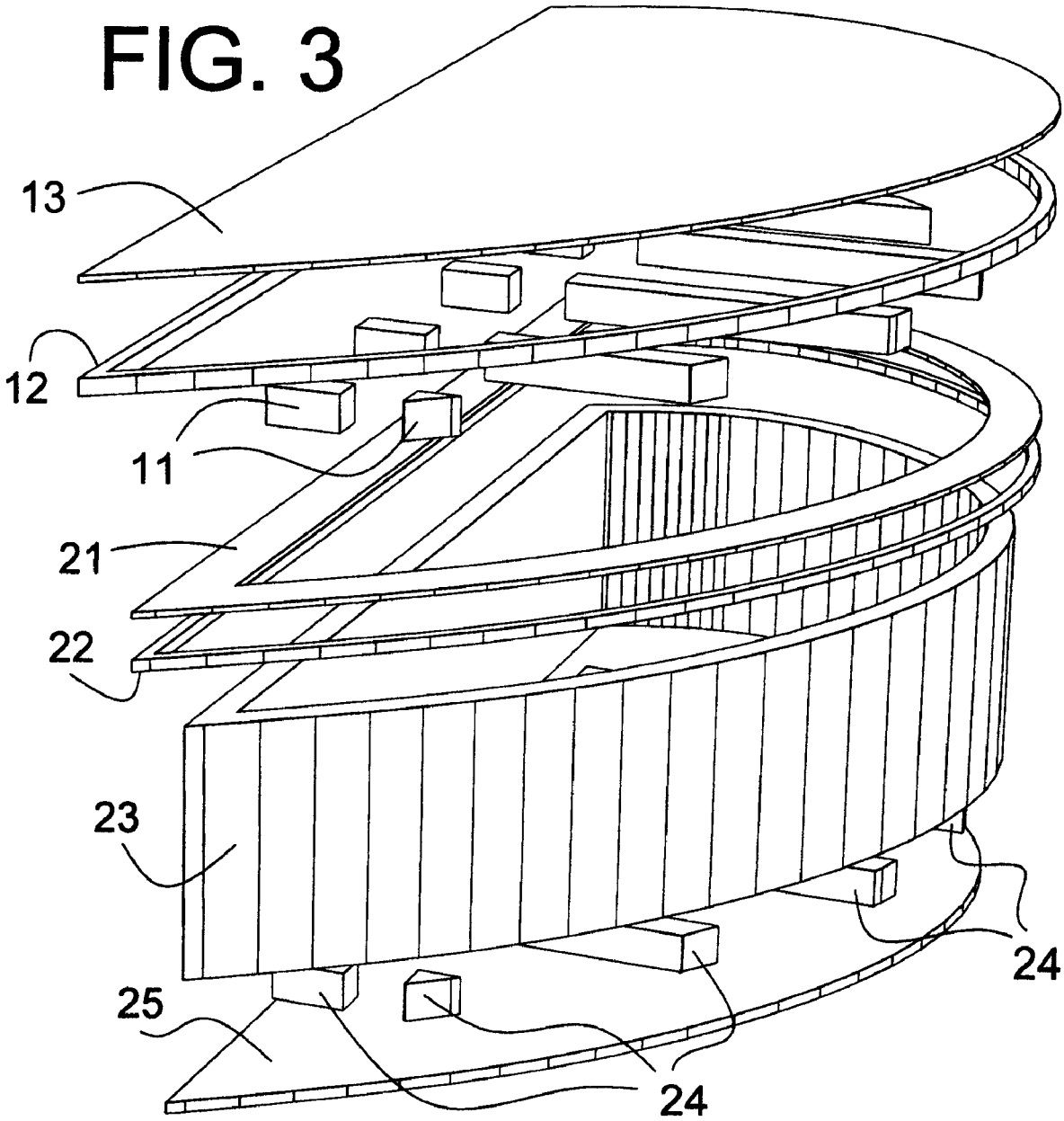
FIG. 3 depicts a perspective exploded view of one embodiment of the half heart shaped vault
Figure 4:
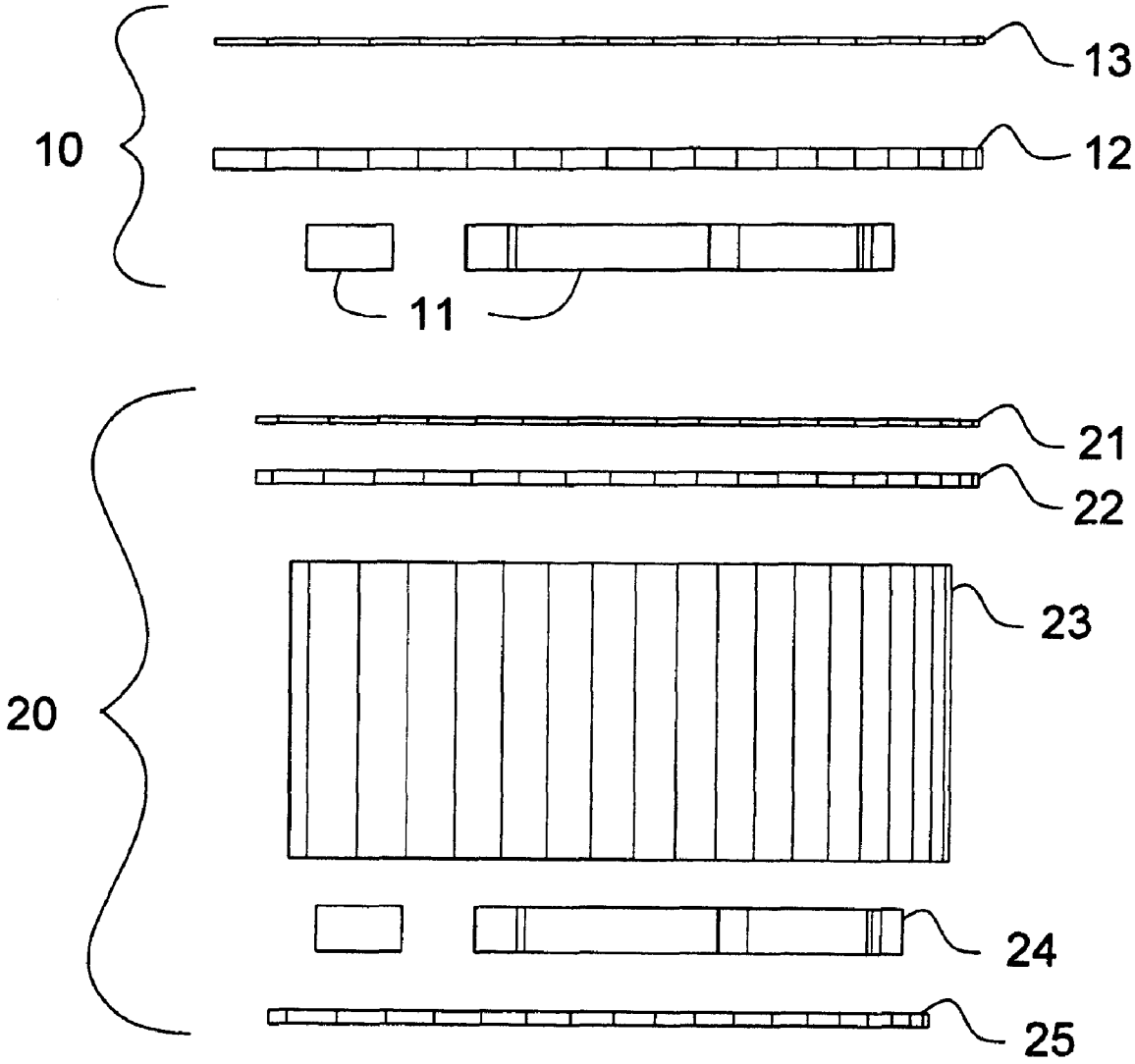
FIG. 4 depicts a side exploded view of one embodiment of the half heart shaped vault
Figure 5:
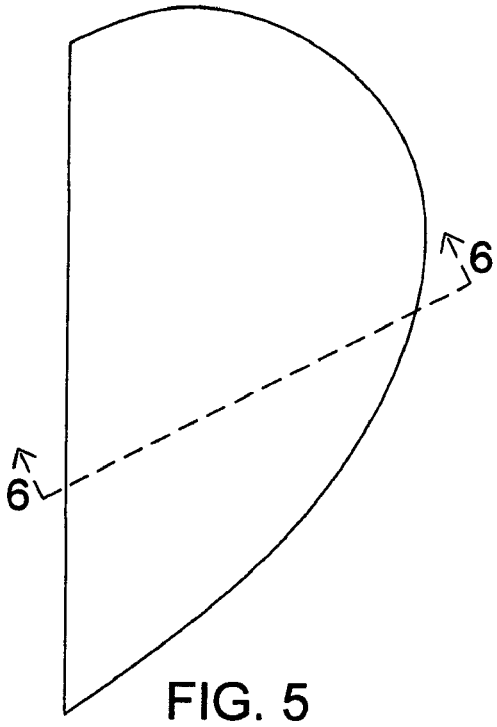
FIG. 5 depicts a top view of one embodiment of the half heart shaped vault
Figure 6:
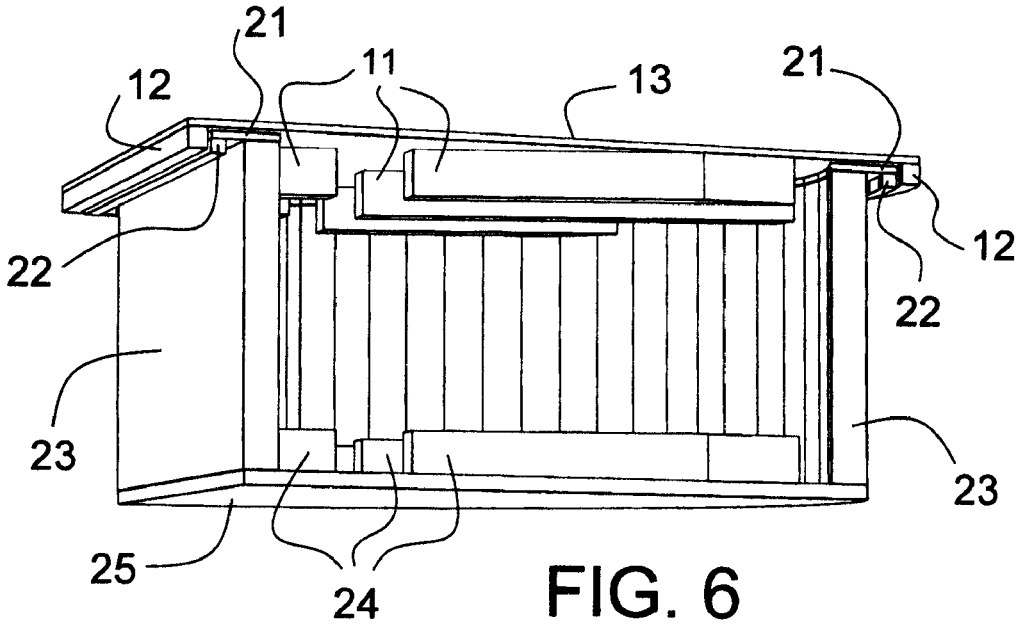
FIG. 6 depicts a cross sectional view as depicted in FIG. 5
Figure 7:
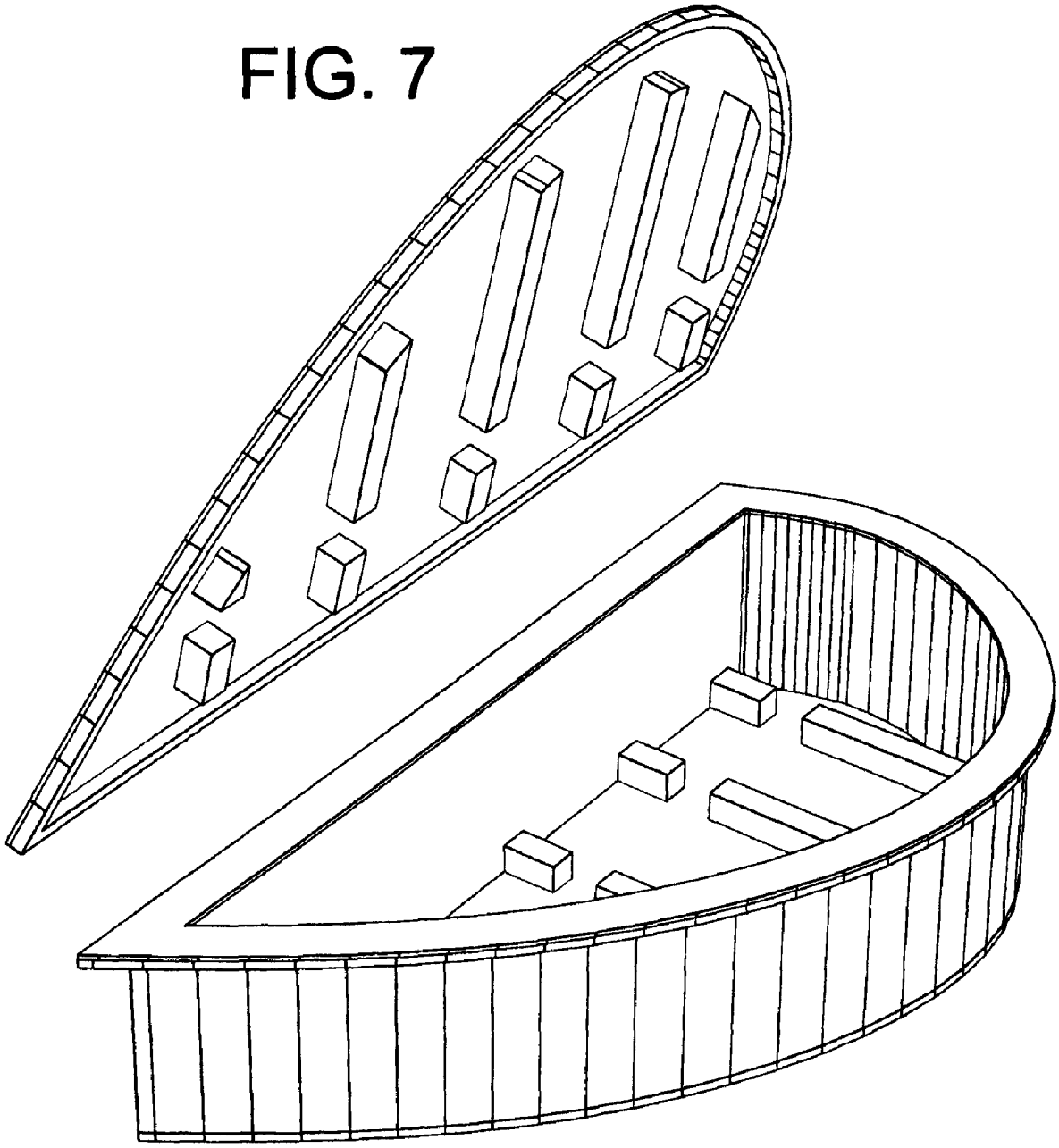
FIG. 7 depicts a perspective view of one embodiment of the half heart shaped vault
Figure 8:
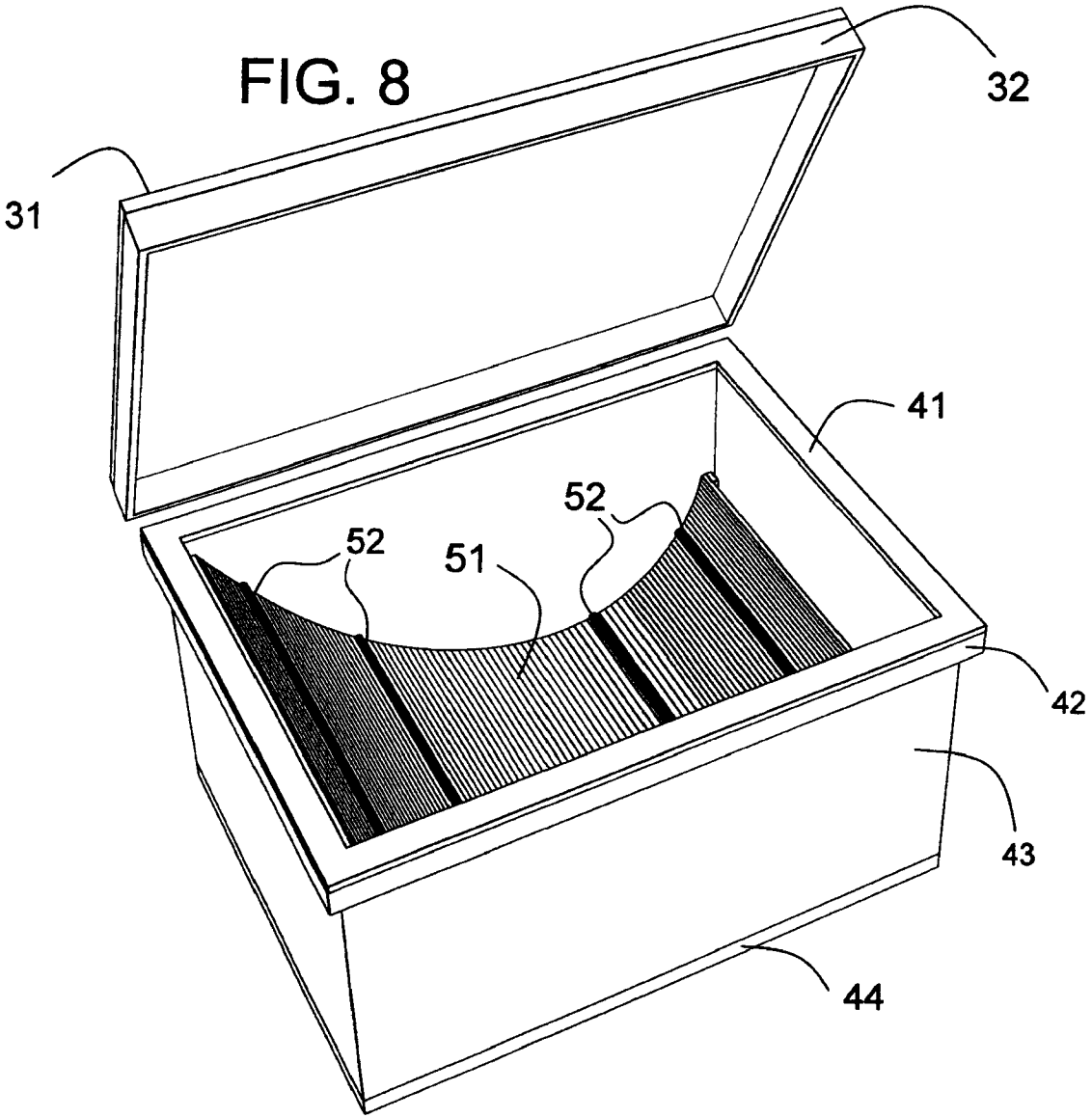
FIG. 8 depicts a perspective view of one embodiment of a rectangular vault having inner curved support means
Figure 9:
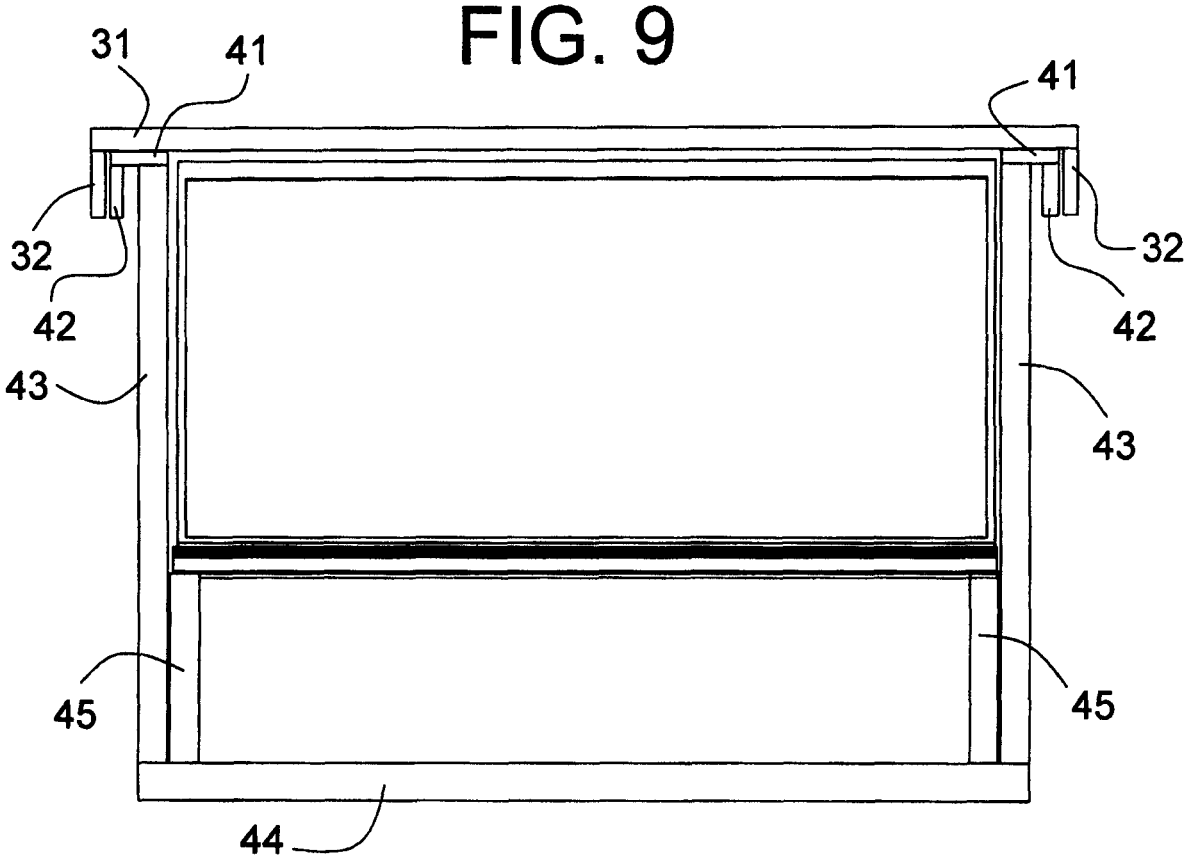
FIG. 9 depicts a cross sectional view of one embodiment of a rectangular vault having inner curved support means
Figure 10:
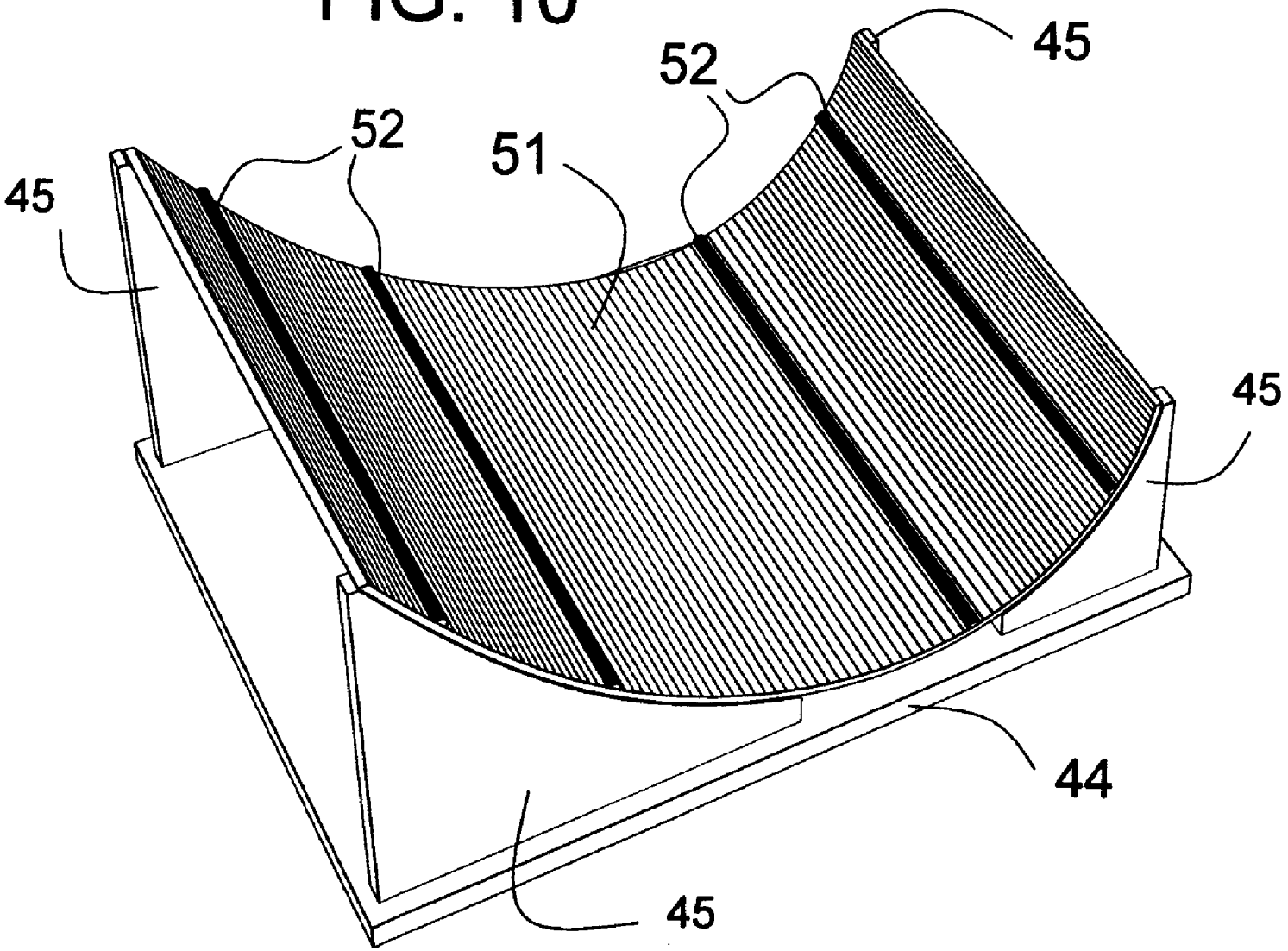
FIG. 10 depicts a partial perspective view of one embodiment of a rectangular vault having inner curved support means

The table below lists the reference numerals employed in the figures, and identifies the element designated by each numeral.

| | |
|---|---|
| 10 | half heart cover assembly 10 |
| 11 | upper support ribs 11 of half heart cover assembly |
| 12 | cover lip 12 of half heart cover assembly |
| 13 | cover 13 of half heart cover assembly |
| 20 | half heart enclosure assembly 20 |
| 21 | upper support 21 of half heart enclosure assembly |
| 22 | upper support lip 22 of half heart enclosure assembly |
| 23 | vertical side wall 23 of half heart enclosure assembly |
| 24 | lower support ribs 24 of half heart enclosure assembly |
| 25 | bottom 25 of half heart enclosure assembly |
| 30 | rectangular cover assembly 30 |
| 31 | cover 31 of rectangular cover assembly |
| 32 | cover lip 32 of rectangular cover assembly |
| 40 | rectangular enclosure assembly 40 |
| 41 | upper support 41 of rectangular enclosure assembly |
| 42 | upper support lip 42 of rectangular enclosure assembly |
| 43 | vertical side wall 43 of rectangular enclosure assembly |
| 44 | bottom 44 of rectangular enclosure assembly |
| 45 | curved support members 45 of rectangular enclosure assembly |
| 51 | curved support base 51 of rectangular enclosure assembly |
| 52 | support base ribs 52 of rectangular enclosure assembly |
| 60 | heart shaped coffin 60 |

DETAILED DESCRIPTION

One embodiment of a half heart shaped vault comprises half heart cover assembly 10 and half heart enclosure assembly 20. Half heart shaped assembly 10 has upper support ribs 11 that are affixed to the underside of cover 13 and cover lip 12 that is affixed to the underside of cover 13 approximate the outer periphery thereof.

Half heart shaped enclosure assembly 20 has bottom 25 and vertical side wall 23 that form essentially a half heart shape; upper support lip 22 is affixed to the underside of upper support 21; upper support 21 is affixed to the top of vertical side wall 23.

Upper support lip 22 and upper support 21 cooperatively fit with cover lip 12 and cover 13 when the cover assembly 10 is placed on top of the enclosure assembly 20. Lower support ribs 24 are affixed to the top of bottom 25.

In one embodiment, a plurality of upper and lower support ribs 11, 24 are used in the cover assembly 10 and enclosure assembly 20. They are displaced laterally with respect to a coffin placed within the vault. Their purpose is to hold the coffin in place.

Upper and lower support ribs 11, 24 are bifurcated into first and second portions to accommodate the protruding handles on the sides of a coffin being displaced between the first and second portions.

For an example of such handles, see U.S. application Ser. No. 12/430,882 of Antoine Elhaj, filed Apr. 27, 2009, entitled "Broken Heart Shaped Coffin" wherein the coffin in at least one embodiment comprises side handles.

One of skill in the art will appreciated that the handles will likely be on both sides of the coffin so the upper and lower support ribs should be bifurcated to form a space to coincide with the location of the handles which can be placed in varying arrangements.

One embodiment of a vault comprises rectangular cover assembly 30 and rectangular enclosure assembly 40. Rectangular cover assembly 30 comprises rectangular cover 31 and cover lip 32 attached to the underside of cover 31 essentially around the periphery thereof. Rectangular enclosure assembly 40 has upper support 41, upper support lip 42, vertical side wall (a.k.a. "wall") 43, bottom 44, curved support members 45, curved support base 51, and support base ribs 52. Rectangular bottom 44 is attached to vertical side wall 43 essentially around the periphery thereof.

Figure 11:
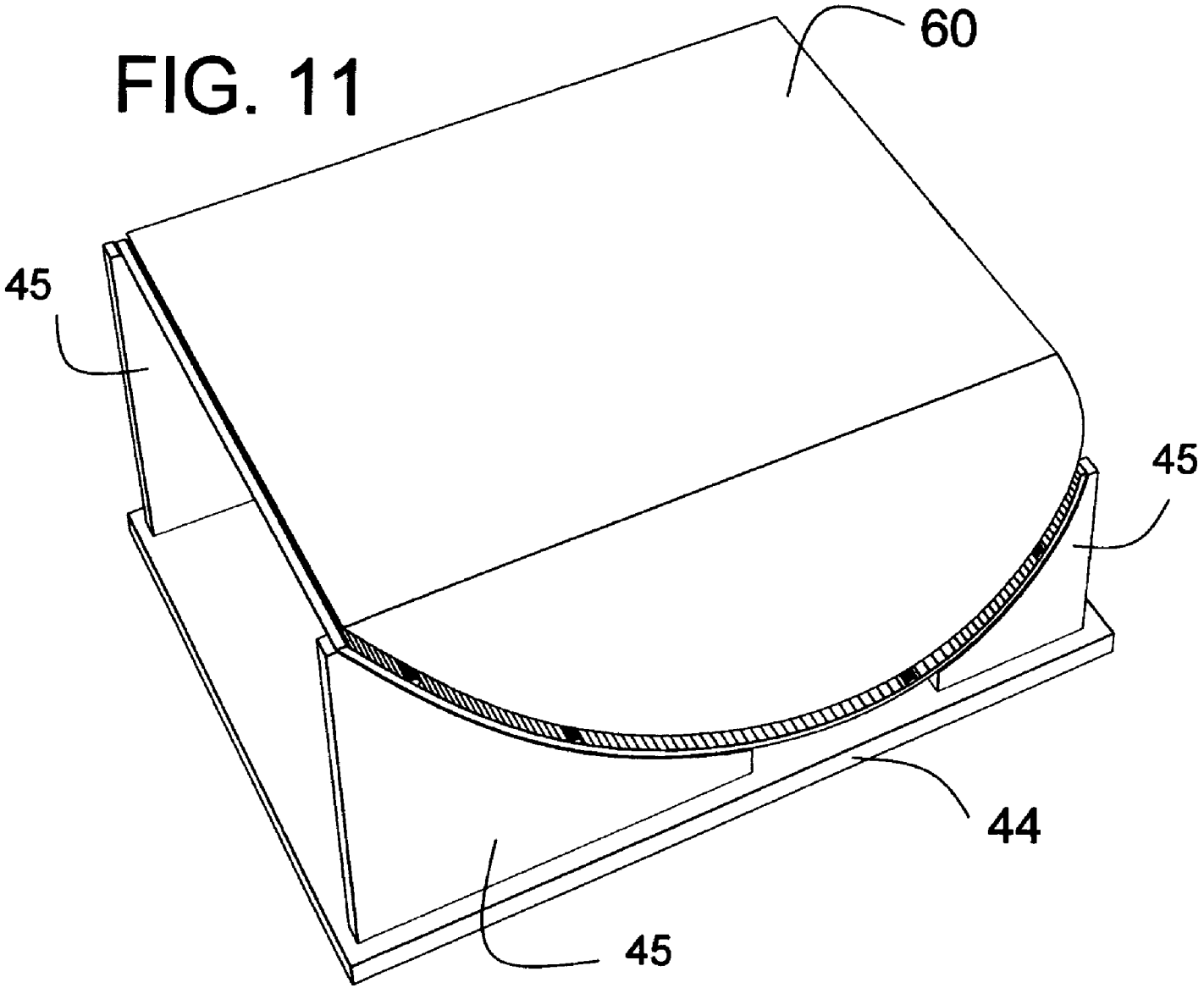
FIG. 11 depicts a partial perspective view of one embodiment of a rectangular vault having inner curved support means and holding a half heart shaped coffin
Figure 12:
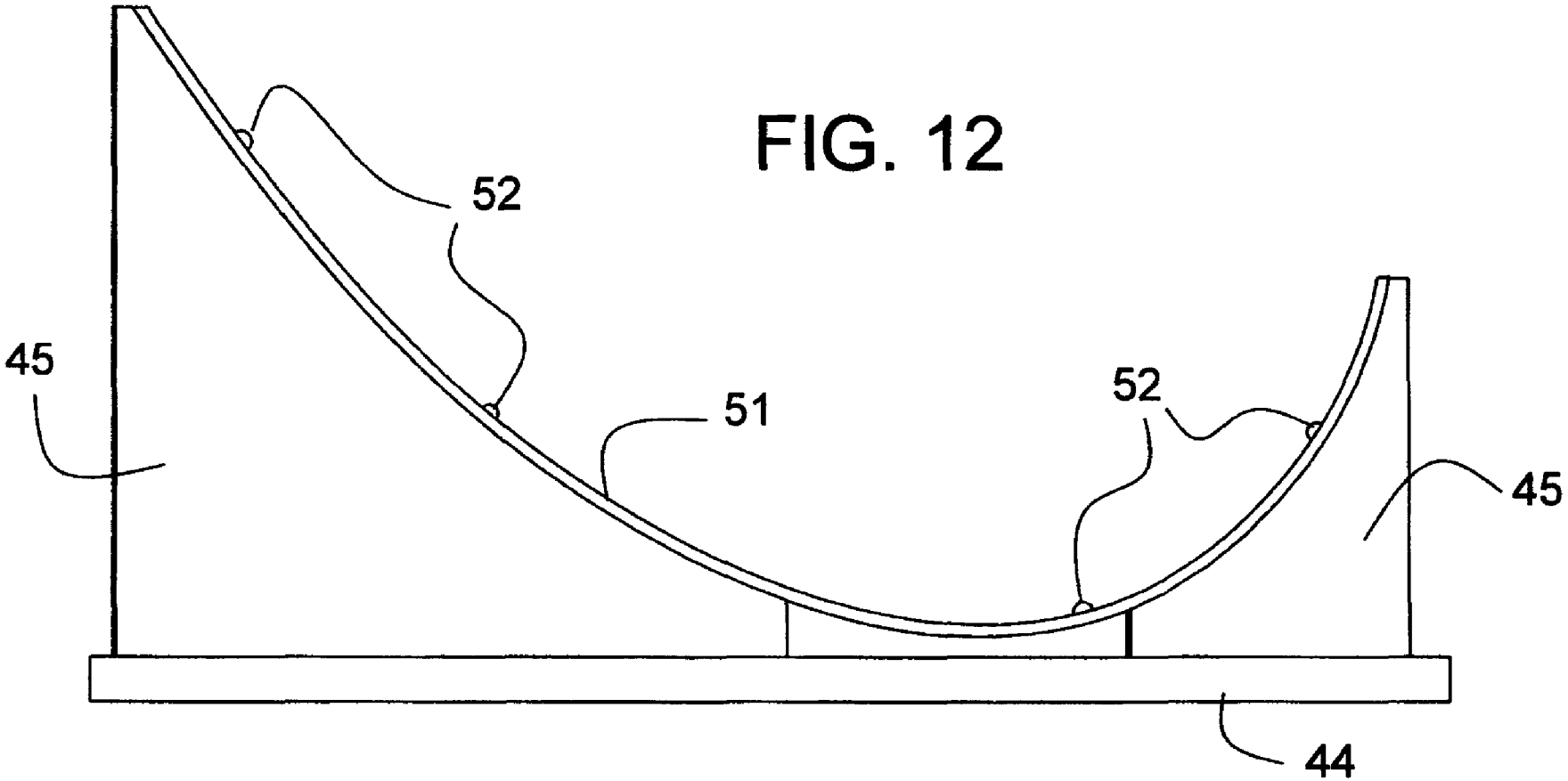
FIG. 12 depicts a partial side view of one embodiment of a rectangular vault having inner curved support means

Curved support base 51 is adapted to hold a heart shaped coffin (FIG. 11). FIG. 11 depicts a heart shaped coffin generally. Four curved support members 45 are attached to bottom 44. They are adapted to support the curved support base vertically above the bottom.

Upper support 41 is attached to the top of the vertical side wall 43. Upper support lip 42 is attached to the underside of upper support 41 essentially around the periphery thereof. Upper support lip 42 and upper support 41 cooperatively fit with cover lip 32 and cover 31 when cover assembly 30 is placed on top of the enclosure assembly 40. Four support base ribs 52 are attached laterally across the curved support base whereby a heart shaped coffin can be vertically offset from the curved support base. This is further advantageous in that the vertical offset facilitates the removal of retaining straps that are commonly used to lower coffins into vaults.

What is claimed is:

1. A half heart shaped vault for storing a heart shaped coffin, the half heart shaped vault comprising:

a half heart shaped cover;

and a half heart shaped enclosure for storing the heart shaped coffin therein, the enclosure having a bottom having essentially a half heart shape and a vertical side wall attached to the bottom essentially around the periphery thereof;

the half heart shaped cover further comprises, an upper support rib being affixed to an underside of the cover, and a cover lip being affixed to the underside of the cover approximate an outer periphery thereof;

the half heart shaped enclosure further comprises, an upper support lip being affixed to an underside of an upper support, the upper support being affixed to a top of the vertical side wall, and a lower support rib being affixed to a top surface of a bottom of the enclosure.

2. A half heart shaped vault for storing a heart shaped coffin, the half heart shaped vault comprising:

a half heart shaped cover;

and a half heart shaped enclosure for storing the heart shaped coffin therein, the enclosure having a bottom having essentially a half heart shape and a vertical side wall attached to the bottom essentially around the periphery thereof;

the half heart shaped cover further comprises, an upper support rib being affixed to an underside of the cover, and a cover lip being affixed to the underside of the cover approximate an outer periphery thereof;

the half heart shaped enclosure further comprises, an upper support lip being affixed to an underside of an upper support, the upper support being affixed to a top of the vertical side wall, and a lower support rib being affixed to a top surface of a bottom of the enclosure;

the upper and lower support ribs are bifurcated into first and second portions to accommodate protruding handles on sides of the coffin between the first and second portions when the coffin is placed within the vault.

3. A vault for storing a heart shaped coffin, the vault comprising:

a rectangular cover;

a rectangular enclosure assembly having, a rectangular bottom and a vertical side wall attached to the bottom essentially around the periphery thereof, a curved support base adapted to mate with a corresponding shaped curved bottom surface of the heart shaped coffin to support the heart shaped coffin thereon, four curved support members attached to the bottom and being adapted to support the curved support base vertically above the bottom;

a cover lip attached to an underside of the cover essentially around the periphery thereof;

an upper support attached to a top of the vertical side wall;

an upper support lip attached to an underside of the upper support essentially around the periphery thereof;

and a plurality of support base ribs attached laterally across the curved support base whereby the curved bottom surface of the heart shaped coffin can be vertically offset from the curved support base.

* * * * *